US005816544A

United States Patent [19]

Hsieh

[11] Patent Number: 5,816,544

[45] Date of Patent: Oct. 6, 1998

[54] IMPROVED STRUCTURE OF FOLDAWAY STAND FOR A GOLF BAG

[76] Inventor: Chi-Chung Hsieh, 6F-3, No. 67, Sung-Chiang Road, Taipei City, Taiwan

[21] Appl. No.: 965,977

[22] Filed: Nov. 7, 1997

[51] Int. Cl.[6] ..... A63B 55/00

[52] U.S. Cl. ..... 248/96; 206/315.7; 403/116

[58] Field of Search ..... 248/96, 688, 168, 248/170, 171; 206/315.7, 315.3; 403/116, 328, 164, 165

[56] References Cited

U.S. PATENT DOCUMENTS

| | | | |
|---|---|---|---|
| 5,154,377 | 10/1992 | Suk | 248/96 |
| 5,516,064 | 5/1996 | Hsich | 248/96 |
| 5,676,879 | 10/1997 | Hscich | 248/96 |

*Primary Examiner*—Ramon O. Ramirez
*Attorney, Agent, or Firm*—Rosenberg, Klein & Bilker

[57] ABSTRACT

A foldaway stand having a sliding frame moved along a longitudinal frame bar on a golf bag, two connectors bilaterally coupled to the sliding frame through a slip joint to hold a respective leg, two links having a respective top end pivoted to the connectors and a respective bottom end fastened to a foot plate, a sliding coupling member coupled between the links and moved to force the links toward each other, wherein each connector has a plug hole adapted to receive one round rod at one side of the sliding frame, a locating slot connected to the plug hole at right angles and adapted to hold a locating pin on the round rod so as to prohibit a backward movement of the round rod, and a sliding groove through which the locating pin on the round rod can be moved with the round rod through the plug hole to the locating slot.

2 Claims, 6 Drawing Sheets

IMPROVED STRUCTURE OF FOLDAWAY STAND FOR A GOLF BAG

BACKGROUND OF THE INVENTION

The present invention relates to an improved structure of foldaway stand for a golf bag which improves the structure of the foldaway stand disclosed in U.S. patent Ser. No. 08/599,849, now U.S. Pat. No. 5,673,879.

U.S. patent Ser. No. 08/599,849 discloses a foldaway stand for a golf bag which comprises two mounting frames respectively fastened to a golf bag on its top and bottom cuffs, a frame bar detachably connected between the mounting frames, a sliding frame slidably mounted around the frame bar, two legs pivotably connected to two opposite sides of the sliding frame by a respective connector, a foot plate, and two links connected between the connectors and the foot plate and constrained by hooks on the mounting frame at the bottom cuff of the golf bag. This structure of foldaway stand is functional, however it still has drawbacks. When an excessive torsional force is applied to the connectors to change the angular position of the legs relative to the golf bag, the connectors may be forced away from the sliding frame.

SUMMARY OF THE INVENTION

The present invention improves the structure of foldaway stand disclosed in U.S. patent Ser. No. 08/599,849. According to one aspect of the present invention, the connector which connects one leg to one round rod at one side of the sliding frame has a plug hole adapted to receive one round rod of the sliding frame, a locating slot connected to the plug hole at right angles and adapted to hold a locating pin on the round rod so as to prohibit a backward movement of the round rod, and a sliding groove through which the locating pin of the round rod can be moved with the round rod through the plug hole to the locating slot. According to another aspect of the present invention, a sliding coupling member is coupled between the links and moved to force the links toward each other.

DETAILED DESCRIPTION OF THE PREFERRED EMBODIMENT

Figure 1:
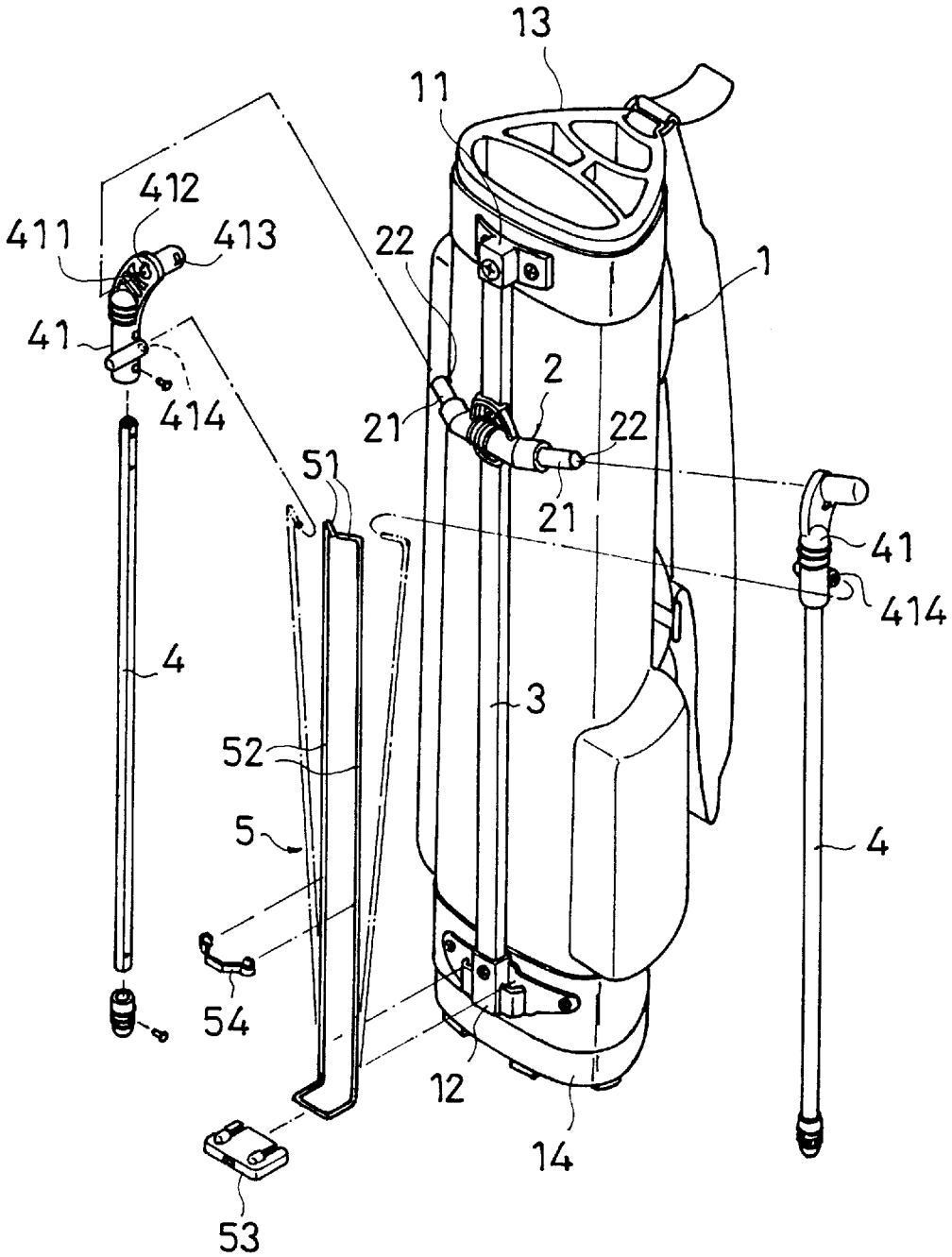
FIG. 1 is an exploded view of the present invention.
Figure 2:
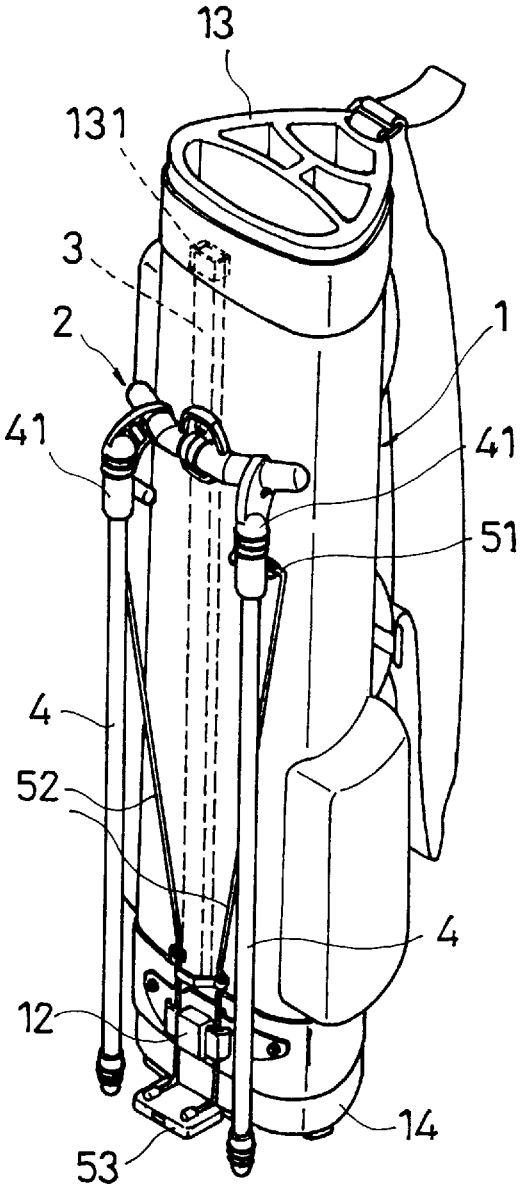
FIG. 2 is a front plain view of the present invention, showing the foldaway stand collapsed.

Referring to FIGS. 1 and 2, a first mounting frame 11 and a second mounting frame 12 are respectively mounted on the top cuff 13 and bottom cuff 14 of a golf bag 1 on the outside. The golf bag 1 has longitudinal steel rods 132 mounted on the inside. The longitudinal steel rods 132 support the golf bag 1 in shape. A frame bar 3 is connected between the first mounting frame 11 and the second mounting frame 12. A sliding frame 2 is coupled to the frame bar 3 and moved along it. The sliding frame 2 comprises two round rods 21 aligned at its two opposite sides, and two locating pins 22 respectively provided at the round rods 21. Two legs 4 are respectively coupled to the round rods 21 of the sliding frame 2 by a respective connector 41. Two links 5 are connected between the connectors 41 and a foot plate 53. The bottom ends of the links 5 are respectively connected to the foot plate 53 and retained in place by the second mounting frame 12.

Figure 3:
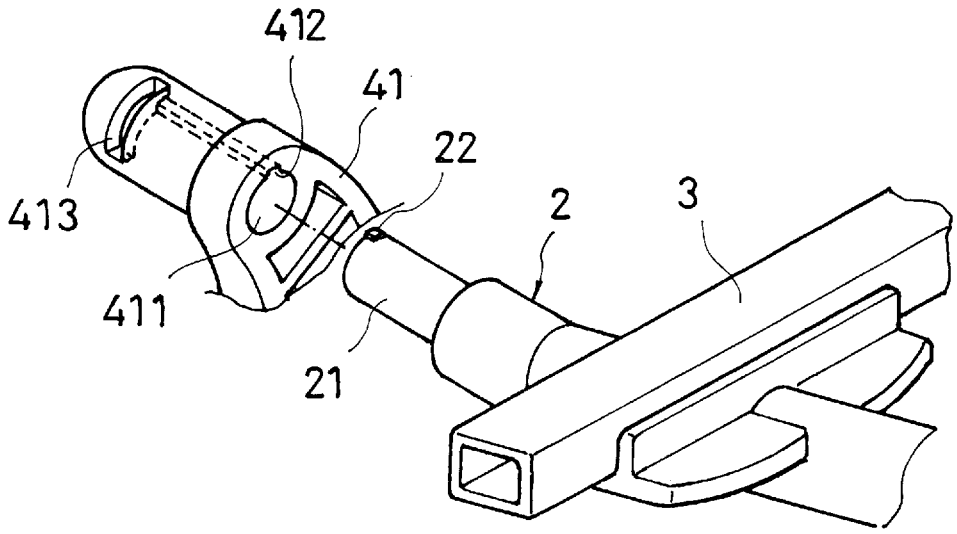
FIG. 3 is a perspective exploded view in an enlarged scale of a part of the present invention, showing the relationship between the connector and the corresponding round rod of the sliding frame.
Figure 4:
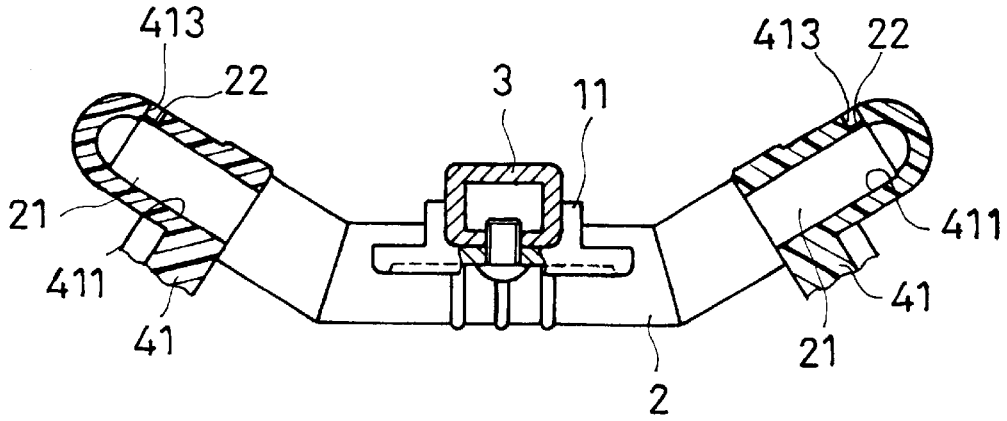
FIG. 4 is a sectional view in an enlarged scale of a part of the present invention, showing the connectors respectively connected to the round rods of the sliding frame.
Figure 3A:
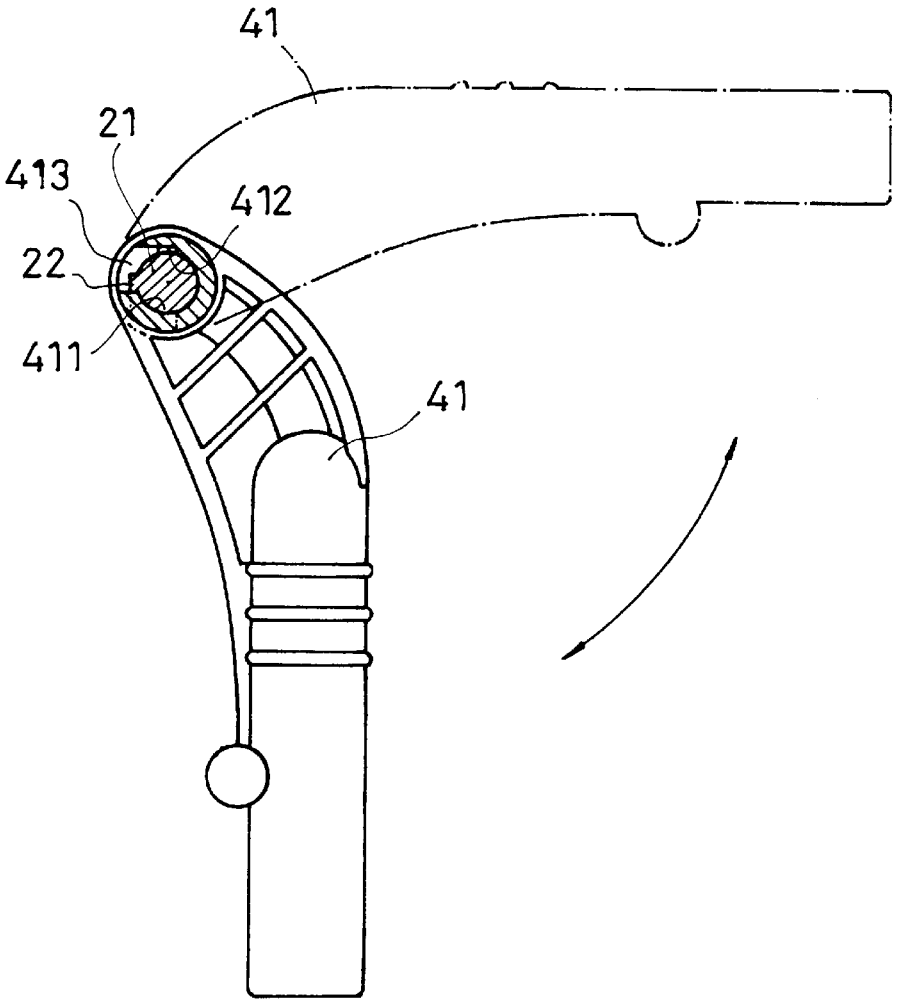
FIG. 3A is a schematic drawing showing the connector turned about the corresponding round rod according to the present invention.

Referring to FIGS. 3, 3A and 4, and FIG. 2 again, the connector 41 comprises a plug hole 411 adapted to receive one round rod 21 of the sliding frame 2, a locating slot 413 connected to the plug hole 411 at right angles, a sliding groove 412 axially disposed inside the plug hole 411 and extended to the locating slot 413, and a pivot hole 414 spaced below the plug hole 411 and disposed in parallel to it. When the locating pin 22 on the round rod 21 at one side of the sliding frame 2 is aligned with the sliding groove 412 of the corresponding connector 41, the round rod 21 can then be inserted into the plug hole 411 of the corresponding connector 41, permitting the locating pin 22 to be moved along the sliding groove 412 into engagement with the locating slot 413. When the locating pin 22 is moved into the locating slot 413, the connector 41 is turned through an angle, permitting the locating pin 22 to be moved in the locating slot 413 away from the sliding groove 412. When the locating pin 22 is moved away from the sliding groove 412 and retained in the locating slot 413, the round rod 21 is prohibited from backward movement relative to the connector 41, and therefore the connector 41 cannot be is connected from the round rod 21. Further, the locating slot 413 limits the turning angle of the connector 41 relative to the round rod 21, i.e., the locating slot defines the extending angle of the leg 4.

Figure 5:
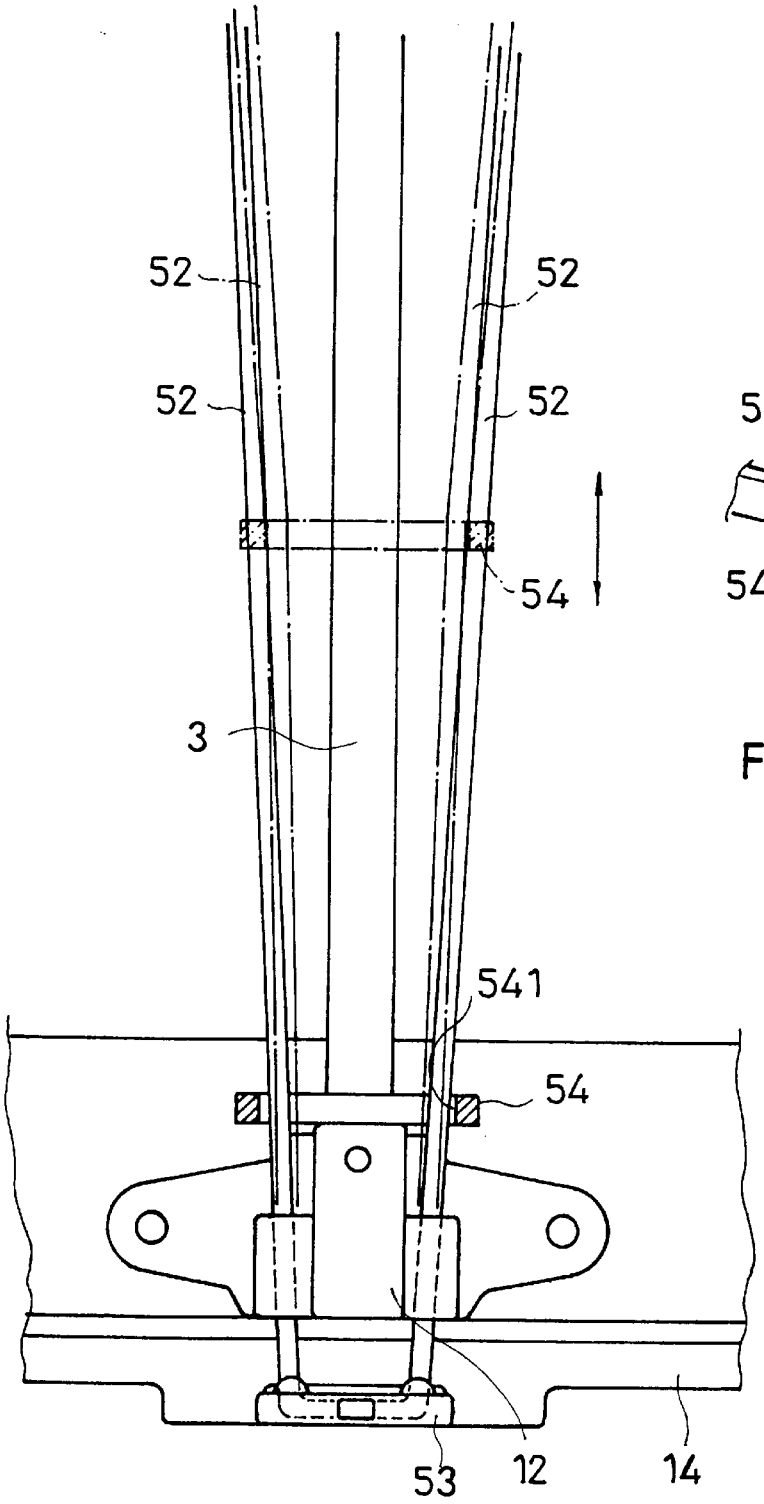
FIG. 5 shows the sliding coupling member moved along the links according to the present invention.
Figure 5A:
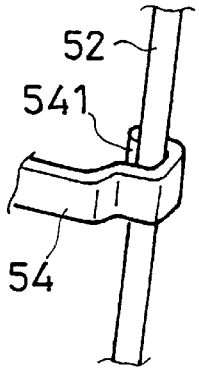
FIG. 5A is a perspective view in an enlarged scale of a part of the present invention, showing one eye end of the sliding coupling member coupled to one rod section of one link.

Referring to FIGS. 5 and 5A, and FIGS. 1 and 2 again, the links 5 have a respective hooked top end 51 respectively coupled to the pivot holes 414 on the connectors 41. A sliding coupling member 54 is provided to couple the links 5 together. The sliding coupling member 54 has two eye ends 541 at two opposite ends respectively coupled to a respective rod section 52 of the links 5. When the sliding coupling member 54 is moved upwards, an inward pressure is applied to the links 5, causing the upper ends of the links 5 to be pulled toward each other.

Figure 6:
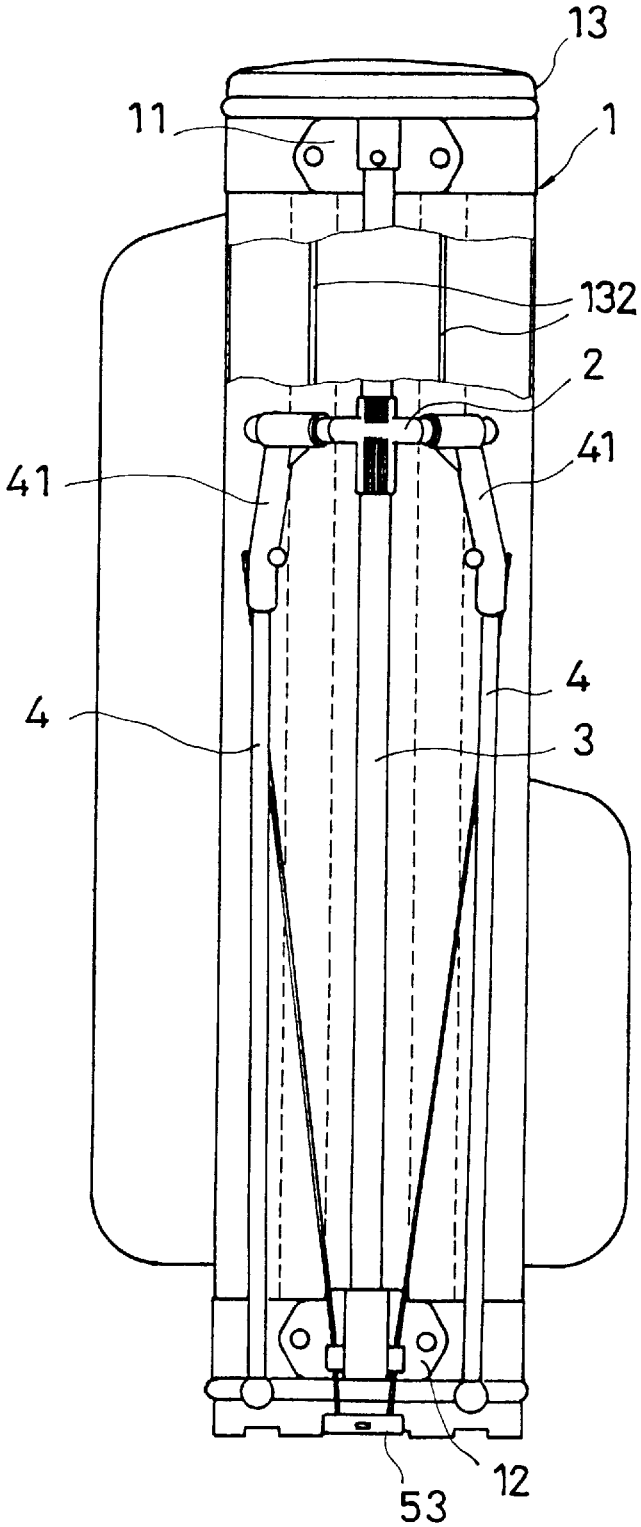
FIG. 6 is a perspective view of an alternate form of the present invention, showing the frame bar mounted outside the golf bag, longitudinal steel rods mounted inside the golf bag.

FIG. 6 shows an alternate form of the present invention, in which the frame bar 3 has its top and bottom ends respectively fastened to a plug hole 131 on the top cuff 13 of the golf bag 1 and a plug hole (not shown) on the bottom cuff 14. Because the frame bar 3 is connected between the top cuff 13 and bottom cuff 14 of the golf bag 1 and disposed inside the golf bag 1, it supports the golf bag 1 in shape. This design eliminates the aforesaid longitudinal steel rods 132 from the golf bag 1.

What the invention claimed is:

1. A foldaway stand of the type comprising a frame bar longitudinally connected between top cuff and bottom cuff of a golf bag, a sliding frame moved along said frame bar, said sliding frame comprising two round rods at two opposite sides, each round rod having a locating pin raised from the periphery, two legs respectively coupled to said sliding frame, two connectors respectively coupled between said legs and the round rods of said sliding frame, a foot plate, and two links respectively coupled between said connectors and said foot plate, wherein said connectors each comprises a plug hole adapted to receive one round rod of said sliding frame, a locating slot connected to said plug hole at right angles and adapted to receive the locating pin on the corresponding round rod, a sliding groove axially disposed inside said plug hole and extended to said locating slot and adapted to guide the locating pin on the corresponding round rod to said locating slot, for permitting the locating pin on the corresponding round rod to be retained in said locating slot; a sliding coupling member is coupled between said links and moved up and down along said links, said sliding coupling member having two eye ends respectively sleeved onto said links, said sliding coupling member imparting an inward pressure to said links when moved upwards, causing said links to be pulled toward each other.

2. The foldaway stand of claim 1, wherein said frame bar has a top end and a bottom end respectively fastened to a respective plug hole on the top cuff and bottom cuff of said golf bag.

* * * * *